US006788797B2

(12) United States Patent
Kim

(10) Patent No.: US 6,788,797 B2
(45) Date of Patent: Sep. 7, 2004

(54) HEADPHONE ACCESSORY

(75) Inventor: Sung-Il Kim, Seongnam (KR)

(73) Assignee: MM Gear Co., Ltd. (KR)

( * ) Notice: Subject to any disclaimer, the term of this patent is extended or adjusted under 35 U.S.C. 154(b) by 0 days.

(21) Appl. No.: 10/398,931

(22) PCT Filed: Oct. 11, 2001

(86) PCT No.: PCT/KR01/01713

§ 371 (c)(1),
(2), (4) Date: Apr. 11, 2003

(87) PCT Pub. No.: WO02/32185

PCT Pub. Date: Apr. 18, 2002

(65) Prior Publication Data

US 2003/0190049 A1 Oct. 9, 2003

(30) Foreign Application Priority Data

Oct. 13, 2000 (KR) ..... 2000/60359

(51) Int. Cl.[7] ..... H04R 25/00

(52) U.S. Cl. ..... 381/371; 381/309; 381/370; 381/374

(58) Field of Search ..... 381/309, 370, 381/371, 376, 372, 374, 182, 186, 71.6, 307, 99; 181/128, 129; 2/209; 379/430

(56) References Cited

U.S. PATENT DOCUMENTS 4,830,138 A * 5/1989 Palmaer et al. ..... 2/209
4,856,118 A * 8/1989 Sapiejewski ..... 2/209
4,989,271 A * 2/1991 Sapiejewski et al. ..... 2/209
5,138,722 A * 8/1992 Urella et al. ..... 2/209
6,038,329 A * 3/2000 Lee ..... 381/370
6,263,085 B1 * 7/2001 Weffer ..... 381/371
6,356,644 B1 * 3/2002 Pollak ..... 381/371

FOREIGN PATENT DOCUMENTS

KR 10-2000-0009587 2/2000
KR 10-2000-0056191 9/2000

* cited by examiner

*Primary Examiner*—Huyen Le
(74) *Attorney, Agent, or Firm*—Lowe Hauptman Gilman & Berner LLP

(57) ABSTRACT

A headphone accessory such as an outer casing for use in combination with a headphone system, which makes the headphone system more comfortable to wear, and serves various function suitable for long time wearing. The headphone accessory includes a sound field-forming member having a cylindrical part, which supports speaker units for reproducing sound from electrical signals or supports enclosures in which the speaker units are mounted, surrounds listener's ears and forms a space in which sound output from the speaker units or enclosures are collected into the listener's ears, and an outer casing formed of an elastic material, which can be separated from the circumference of the cylindrical part of the sound field-forming member and is directly in contact with the side of a listener's head around the ears. Various kinds of an outer casing such as a functional outer casing having improved ventilation for preventing sweating so as to be advantageous for long-time wearing, a fashionable outer casing made of various designs according to user's liking, and an outer casing capable of improving health using functions for keeping warm or cool according to the season and for acupressure, thereby effectively enabling headphones to be worn comfortably for a long time.

20 Claims, 7 Drawing Sheets

HEADPHONE ACCESSORY

BACKGROUND OF THE INVENTION

This application claims the priority of Korean Patent Application No. 2000-60359, filed on Oct. 13, 2000, in the Korean Intellectual Property Office, the disclosure of which is incorporated herein in its entirety by reference.

1. Field of the Invention

The present invention relates to a headphone accessory such as an outer casing, which covers a listener's ears or contacts the side of a listener's face around the ears, is comfortable to wear, is used in combination with a headphone system, and serves various functions suitable for being worn for a long time.

2. Description of the Related Art

Due to the development of multimedia using a personal computer (PC) and digital communication technology, there is a rapidly increasing demand for headphones or headsets, which enable personal non-noise-polluting when viewing movies, listening to music, delving into visual reality, playing games, chatting, or making telephone calls via the Internet. Considering performance, conventional two-channel stereo headphones have been improved upon, resulting in the creation of multi-channel headphones, which reproduce three-dimensional 5.1-channel stereophonic sound. Such multi-channel headphones are disclosed in Korean Patent Applications Nos. 10-2000-0009587 and 10-2000-0056191 by the present applicant.

In conventional two-channel stereo headphones, a speaker unit is mounted in a closed type enclosure which covers a listener's ear, an outer casing surrounds the enclosure, and a cloth or sponge is used for listener comfort.

The multi-channel headphones disclosed in Korean Patent Application No. 10-2000-0009587 provide three-dimensional stereophonic sound by positioning two or more speaker units toward the front and back of each of a listener's ears and mounting each of the speaker units in a separate open type enclosure so as to avoid sound interference and to enable realistic perception of sound direction and space. The multi-channel headphones disclosed in Korean Patent Application No. 10-2000-0056191, as shown in FIGS. 1A and 1B, use a sound field-forming member having a shape which surrounds a listener's ears and supports enclosures in which speaker units are mounted, thus increasing sound effect. The sound field-forming member is covered with a soft outer casing which softly contacts the side of a listener's face around the ears so that outside sound is blocked.

Recently, due to the emergence of the Internet and large capacity multimedia such as digital multi-functional discs, the use of headphones when audio and video chatting, playing on-line games, and viewing movies as well as listening to music using headphones have become popular activities, and thus headphones are used on a much greater scale than in the past.

An outer casing used in conventional headphones makes it comfortable to wear the headphones for a short time but the headphones get sweaty and smelly when worn for a long time, and thus become uncomfortable and unpleasant to wear. Moreover, this problem is more severe in the summer, and when used outdoors in the winter, conventional headphones are not good for keeping a listener's ears warm, and thus it is not easy to use conventional headphones for a long time.

SUMMARY OF THE INVENTION

To solve the above problems, it is a first object of the present invention to provide a headphone accessory having a functional outer casing, which can be used comfortably for a long time in any environment.

It is a second object of the present invention to provide a headphone accessory having a fashionable outer casing having various colored characters and/or designs.

It is a third object of the present invention to provide a headphone accessory having a seasonal outer casing capable of keeping a listener's ears warm or cool according to the season.

It is a third object of the present invention to provide a headphone accessory having a health promoting outer casing having an acupressure function, which stimulates pressure points around a listener's ears.

Accordingly, to achieve the above objects, there is provided a headphone accessory. The headphone accessory includes a sound field-forming member having a cylindrical part, which supports speaker units for reproducing sound from electrical signals or supports enclosures in which the speaker units are mounted, surrounds a listener's ears and forms a space in which sound output from the speaker units or enclosures is collected into the listener's ears, and an outer casing formed of an elastic material, which can be separated from the circumference of the cylindrical part of the sound field-forming member and is directly in contact with the side of a listener's head around the ears.

The present invention relates to a headphone accessory having various kinds of an outer casing such as a fashionable outer casing having various colored characters and/or designs, a seasonal outer casing capable of keeping a listener's ears warm or cool according to the season, and a health promoting outer casing having an acupressure function which stimulates pressure points around a listener's ears when worn.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Hereinafter, preferred embodiments of the present invention will be described in detail with reference to the accompanying drawings.

Figure 1A:
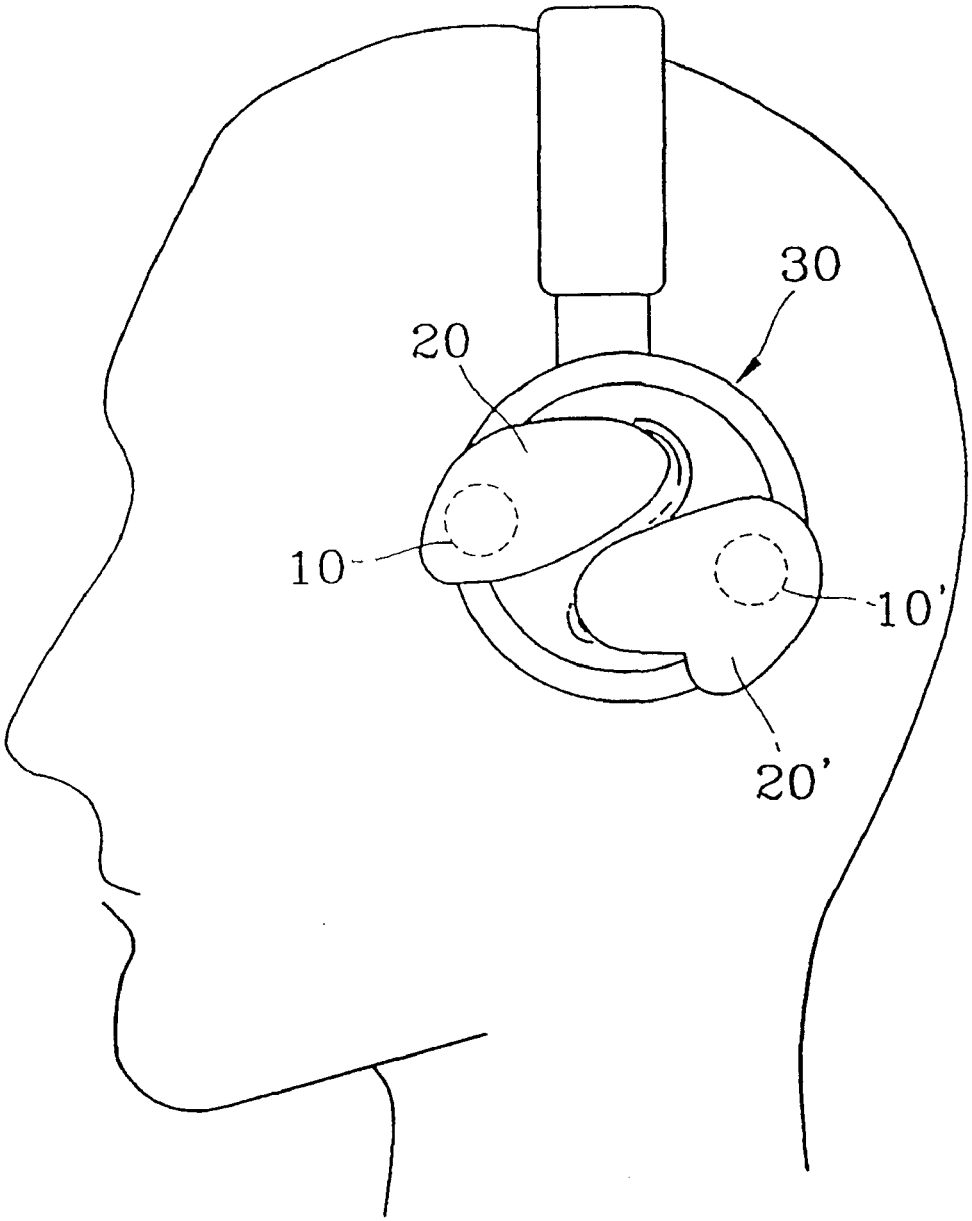
FIGS. 1A and 1B are side views of embodiments of multi-channel headphones according to the present invention.
Figure 1B:
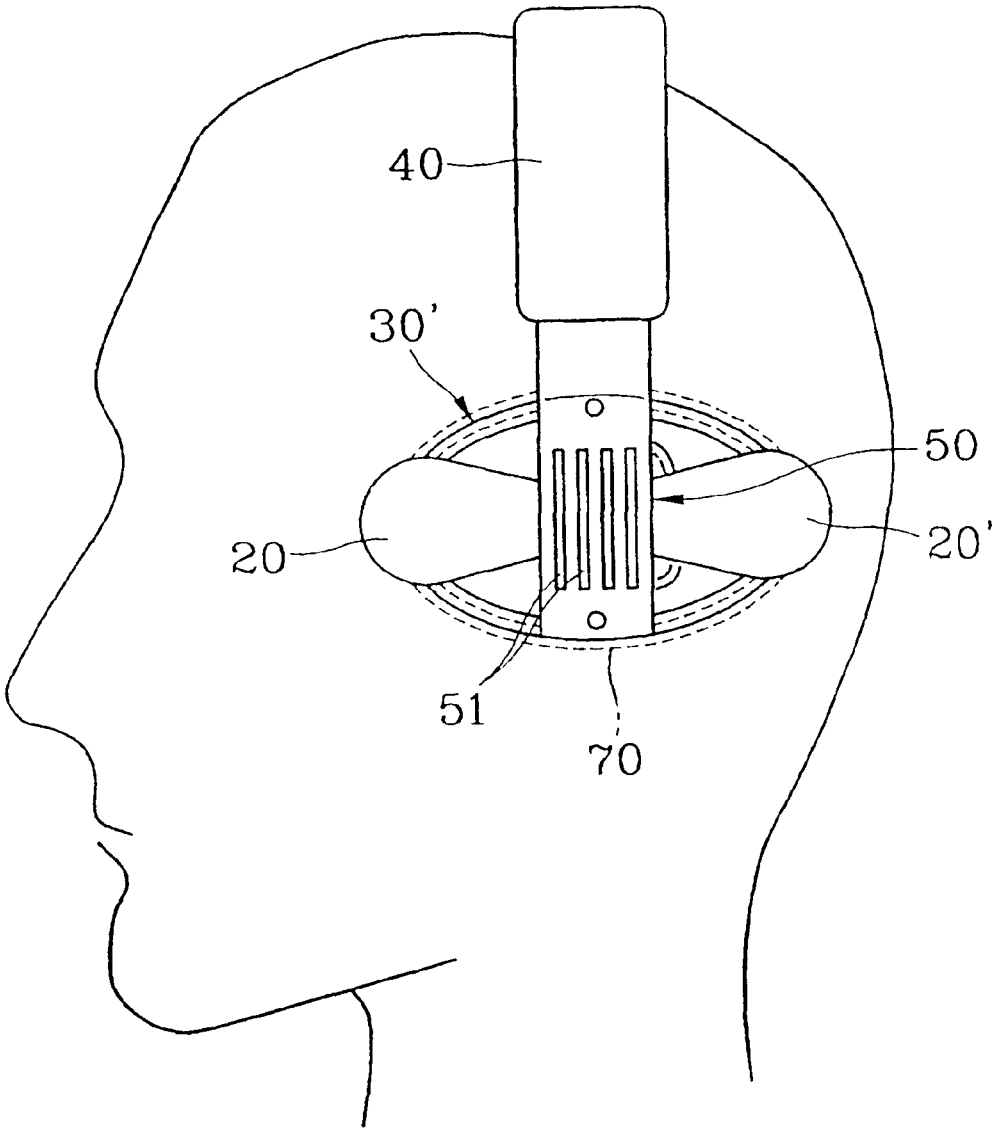

FIGS. 1A and 1B are side views of embodiments of multi-channel headphones according to the present invention. Referring to FIG. 1A, the multi-channel headphones include open type enclosures 20 and 20', which transfer sound to a listener's ears by speaker units 10 and 10' mounted therein and positioned apart to the front and to the back of the listener's ears for reproducing 3D sound. A sound field-forming member 30 is used for forming space for widening sound fields output from the enclosures 20 and 20'. As shown in FIG. 1B, an oval sound field-forming member 30' is preferably used so that the enclosures 20 and 20' can be positioned for apart to the front and to the back of the listener's ears as long as they don't overlap the oval sound field-forming member 30', and a space between ends of the enclosures 20 and 20' is covered with a sound plate 50. Reference numerals 40, 51, and 70 denotes a headband, slits, and an outer casing, respectively.

The structure and function of the enclosures 20 and 20', the sound field-forming members 30 and 30', and the sound plate 50 are described in detail in Korean Patent Applications Nos. 10-2000-0009587 and 10-2000-0056191 by the present applicant.

Figure 2:
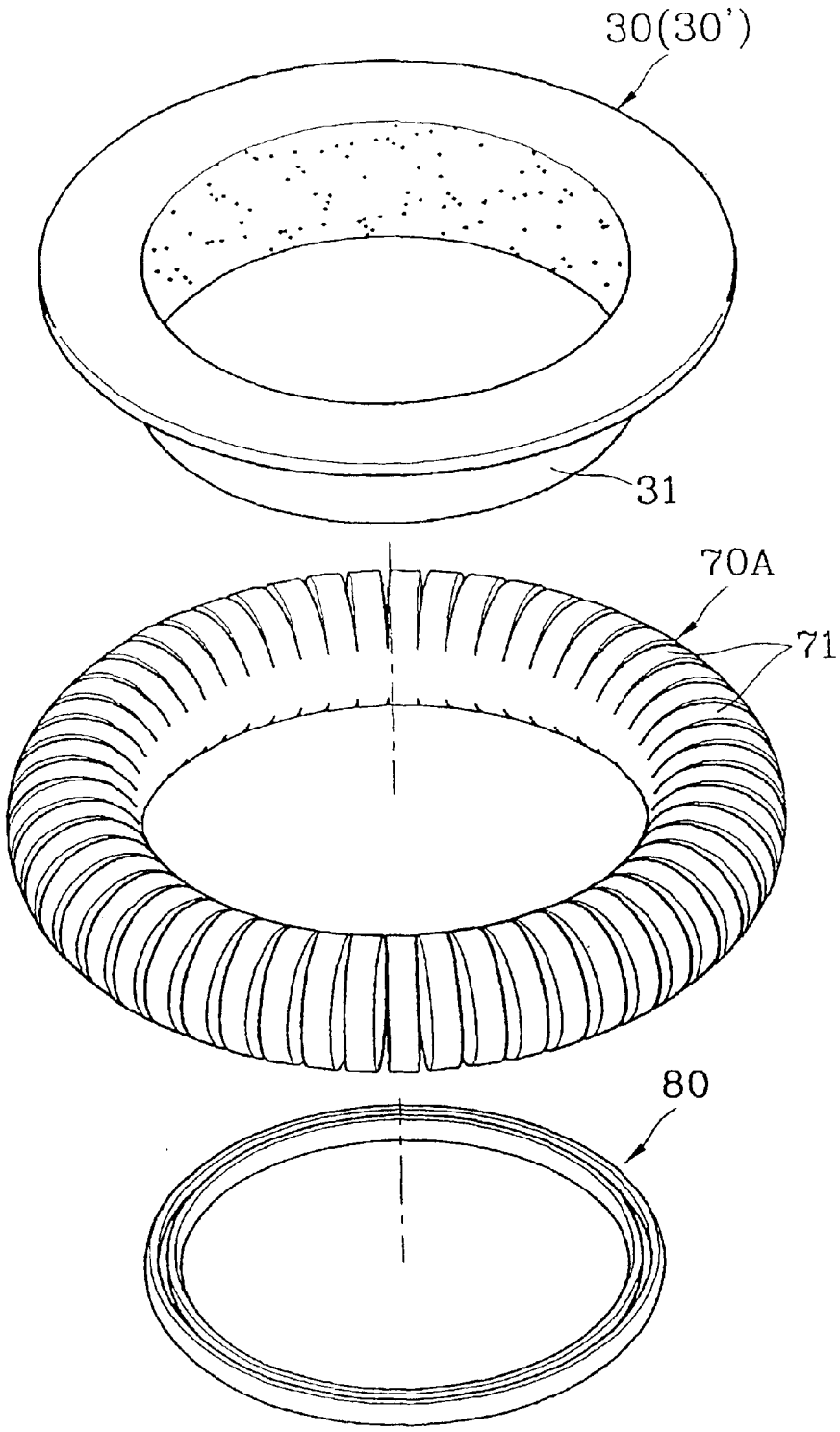
FIG. 2 is an exploded perspective view illustrating the structure of an outer casing of a headphone accessory according to the present invention.

Referring to FIG. 2, the sound field-forming members 30 and 30' of the multi-channel headphones include a cylindrical part 31 for forming a predetermined sound-field space around a listener's ears, and the circumference of the cylindrical part 31 is surrounded by the outer casing 70. The outer casing 70 is directly in contact with the side of a listener's face around the listener's ears, and preferably, silicone which is harmless to the human body, is used for the outer casing 70 for comfort. Configurations of the outer casing 70 will be described in detail with reference to FIGS. 2 through 10.

Figure 3:
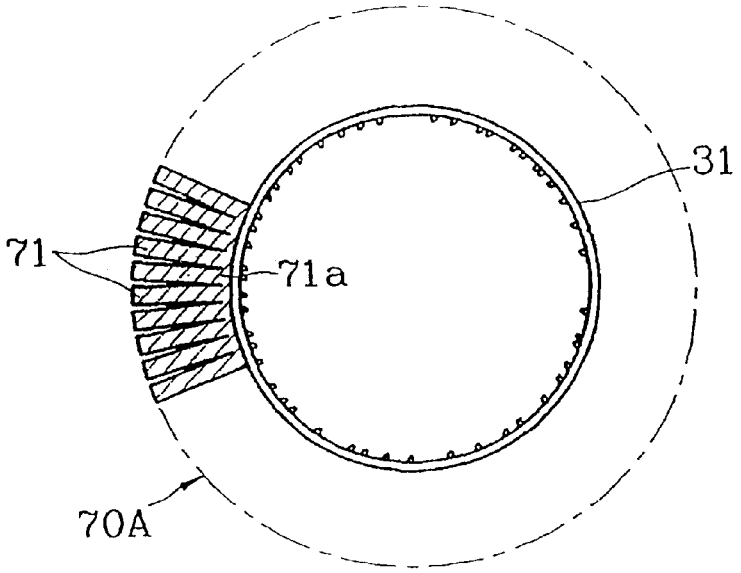
FIG. 3 is a sectional view of a combined state of the headphone accessory shown in FIG. 2, taken parallel to the plane of the headphone accessory.
Figure 4:
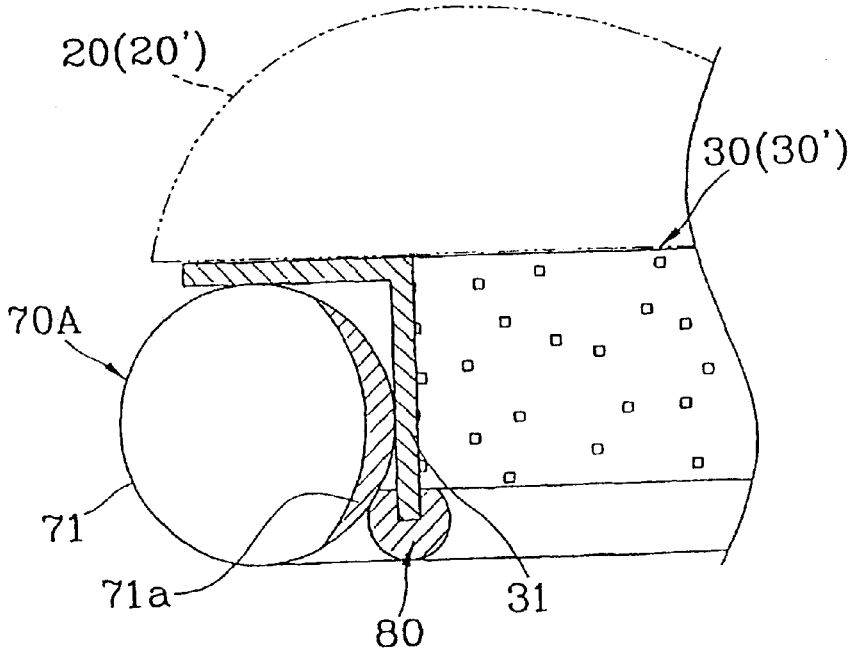
FIG. 4 is a sectional view of a combined state of the headphone accessory shown in FIG. 2, taken perpendicular to the plane of the headphone accessory.

An outer casing 70A shown in FIGS. 2 through 4 is a heat-dissipating section in which a plurality of disc-shaped supporting sections 71 are positioned around the circumference of the cylindrical part 31 of the sound field-forming member 30 in a standing state and inner parts 71*a* of the disc-shaped supporting sections 71 are connected together. Since the outer casing 70A is well ventilated through openings formed between the adjacent disc-shaped supporting sections 71, and provides a wide heat-dissipating area from the surfaces of the disc-shaped supporting sections 71, heat generated around the listener's ears or at the speaker units can be effectively dissipated. Thus, due to ventilation and heat-dissipation effects, the outer casing 70A can be prevented from becoming sweaty even when worn for a long time, and due to the characteristics of silicone, the outer casing 70A does not irritate skin and is comfortable to wear for a long time.

Nevertheless, the outer casing 70A can be separated from the cylindrical part 31 and can be washed with water or soapy water in a separated state. The outer casing 70A formed of an elastic material such as silicone, can seal a space between the end of the cylindrical part 31 and the side of the listener's face, and thus stably forms a sound field-forming space in the cylindrical part 31, resulting in improved sound field effects.

Figure 5:
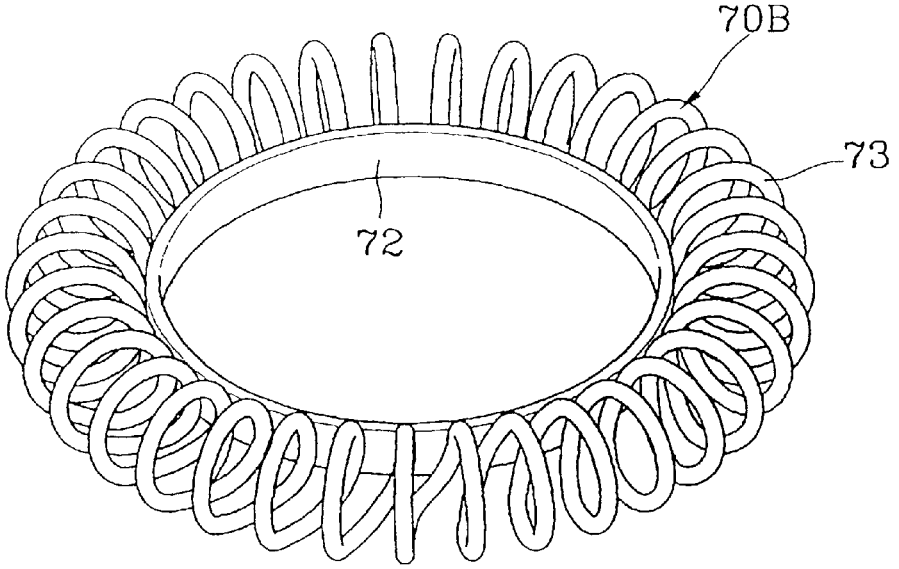
FIG. 5 is a perspective view illustrating a functional outer casing for use in a headphone accessory according to an embodiment of the present invention.
Figure 6:
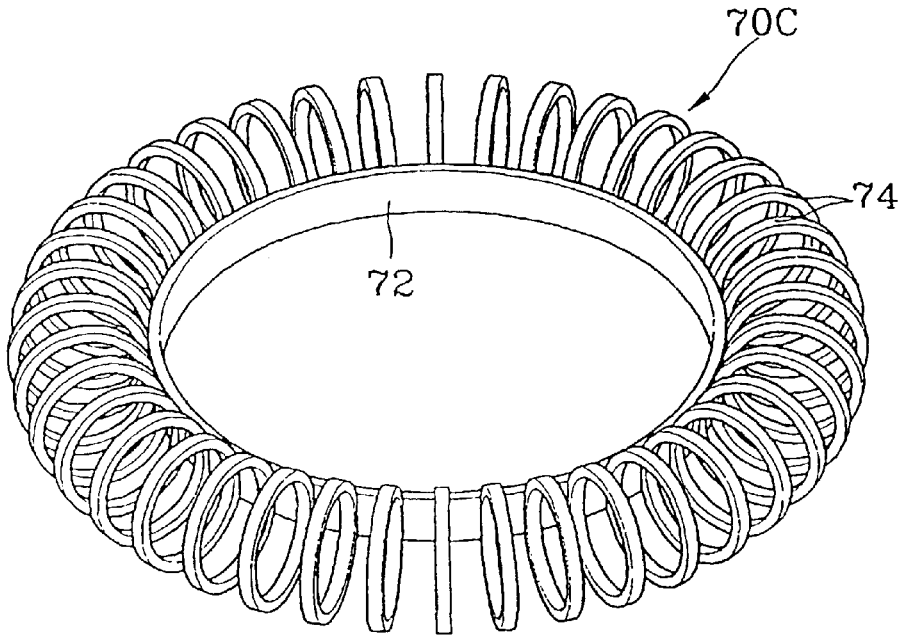
FIG. 6 is a perspective view illustrating a functional outer casing for use in a headphone accessory according to another embodiment of the present invention.

FIGS. 5 and 6 illustrate armoring bodies 70B and 70C having a structure which is even better ventilated than the radiation fin structure of the outer casing 70A. The outer casing 70B shown in FIG. 5 is a ring-shaped coil and includes a band member 72, which is elastically closely adhered to the circumference of the cylindrical part 31 of the sound field-forming member 30, and a ring coil member 73, which is wound in a spring coil shape, connected end to end to form a circle, and then attached to the outside of the band member 72. The outer casing 70C shown in FIG. 6 is ring-shaped and includes a band member 72, which is elastically closely adhered to the circumference of the cylindrical part 31 of the sound field-forming member 30, and a plurality of supporting rings 74, which are vertically oriented and attached to the outside of the band member 72 as one body.

Figure 7:
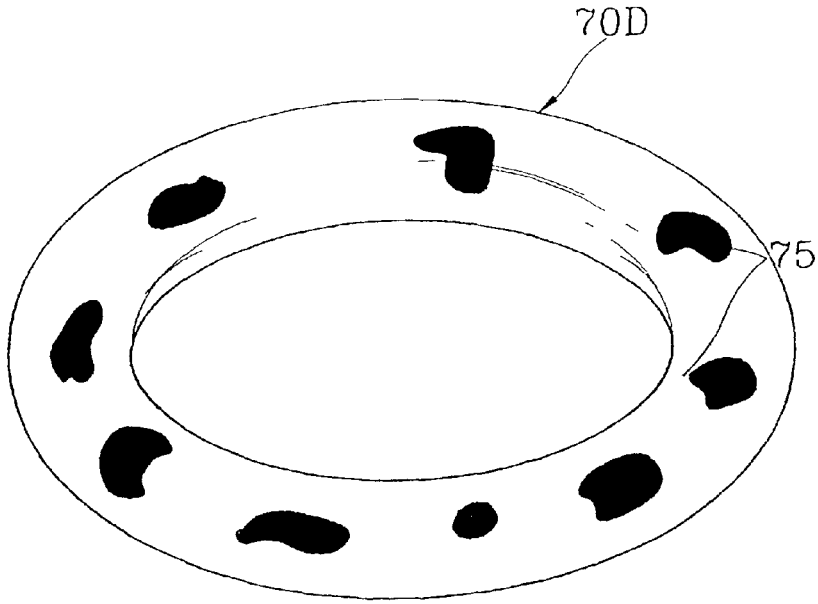
FIG. 7 is a perspective view illustrating a fashionable outer casing for use in the headphone accessory according to an embodiment of the present invention.

FIG. 7 illustrates a fashionable outer casing 70D. The fashionable outer casing 70D can have various colors, characters and designs 75 printed on the surface of a silicone body to look attractive.

Figure 8:
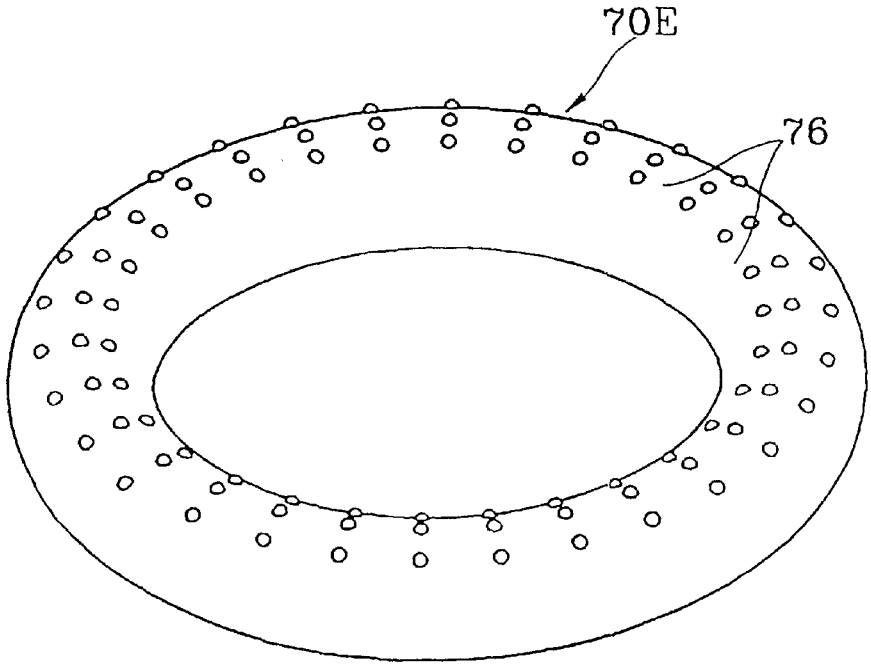
FIG. 8 is a perspective view illustrating a health promoting outer casing for use in the headphone accessory according to an embodiment of the present invention.

FIG. 8 illustrates an outer casing 70E for acupressure. The outer casing 70E includes a plurality of acupressure protrusions 76 which protrude from the surface of a silicone body or just from a portion contacting the side of the listener's head. The acupressure protrusions 76 stimulate pressure points around the listener's ears when the headphones are worn. Thus, the outer casing 70E can be used to quit smoking or loosing weight according to the position of the protrusions and can be separated from the headphones and carried in hand for doing grip exercises and palm acupressure.

Figure 9:
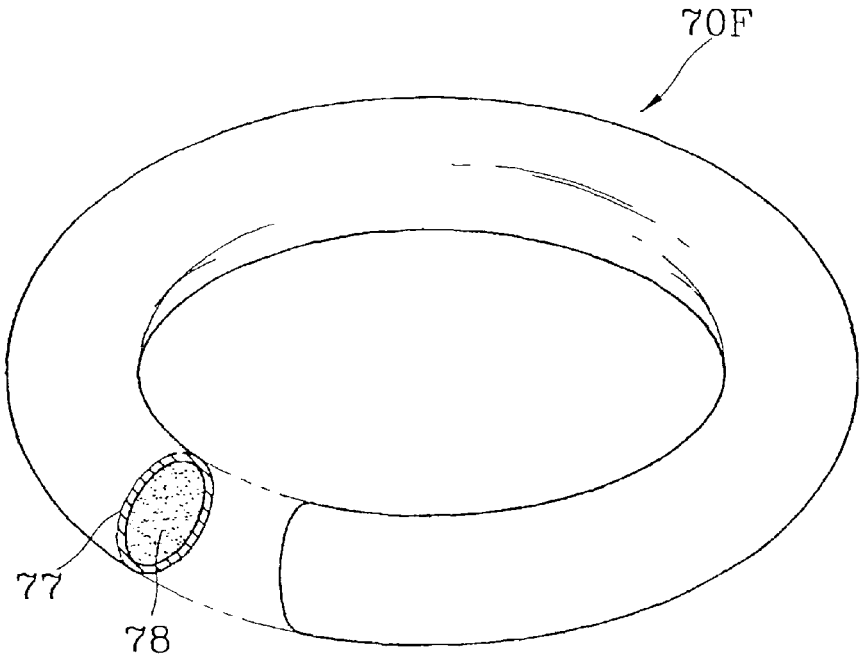
FIG. 9 is a perspective view illustrating a health promoting outer casing for use in the headphone accessory according to another embodiment of the present invention.

FIG. 9 illustrates a cool and warm pack-type outer casing 70F. The cool and warm pack-type outer casing 70F includes a ring-shaped hollow tube 77, and the inside of the tube 77 is filled with a medium 78 having a function for keeping warm or cool. A conventional medium, which is disclosed in Utility Model registration Nos. 4050 and 195982, is used as the medium 78 having a function for keeping warm or cool. The cool and warm pack-type outer casing 70F can be used for a long time in cool or hot weather by using the function for keeping warm or cool.

Figure 10:
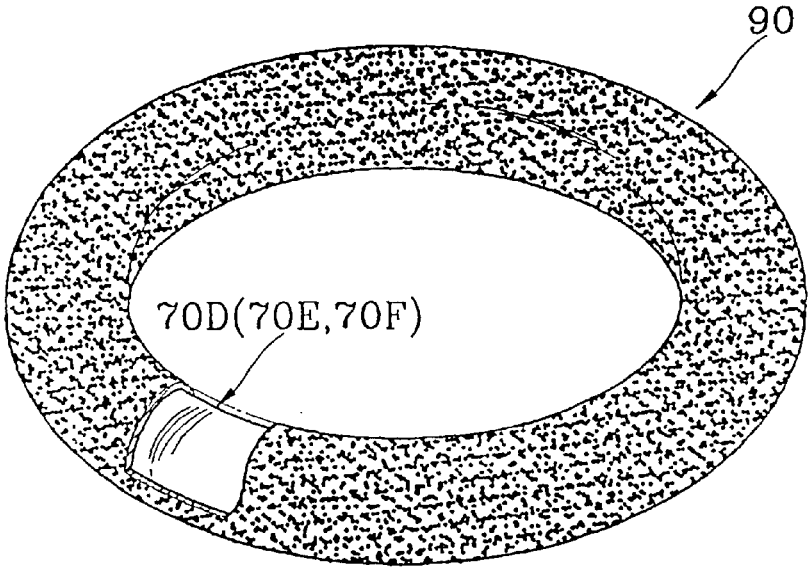
FIG. 10 is a perspective view illustrating a health promoting outer casing for use in the headphone accessory according to yet another embodiment of the present invention.

FIG. 10 illustrates a state in which any of the armoring bodies 70D, 70E, and 70F is wrapped in a cover 90 made of cotton or a woolen cloth. A cover made of cotton can be used in the hot summer to increase absorption of sweat, and a cover made of a woolen cloth can be used in the cold winter so as to improve the function for keeping warm.

The above embodiments of the present invention have been described with reference to multi-channel headphones according to Korean Patent Applications Nos. 10-2000-0009587 and 10-2000-0056191 by the present applicant, but the present invention can be also applied to conventional two-channel stereo headphones.

As described above, the headphone accessory allows a listener to wear headphones comfortably for a long time, such as when viewing movies. Further, the present invention can be covered with various designs, to be worn for fashion and can have various functions such as keeping a listener's ears warm or cool according to the season, and acupressure.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An accessory for a multi-channel headphone providing three-dimensional stereophonic sound by positioning two or more enclosures, in each of which a speaker unit is enclosed toward the front and back of each ear of a listener, said accessory comprising:

a sound field-forming member having a cylindrical part, which supports the enclosures, surrounds the listener's ears and forms a space for widening a sound field output from the enclosures; and an outer casing formed of an elastic material, which can be separated from the circumference of the cylindrical pa of the sound field-forming member and is directly in contact with the side portion of the listener's head around the ears.

2. The accessory of claim 1, wherein the outer casing is formed mainly of silicone.

3. The accessory of claim 1, wherein the outer casing has a shape in which a plurality of disc-shaped supporting sections are positioned around the circumference of the cylindrical part of the sound field-forming member and inner parts of the disc-shaped supporting section are connected to one another.

4. The accessory of claim 1, wherein the outer casing includes a band member, which is elastically closely adhered to the circumference of the cylindrical part of the sound field-forming member, and a ring coil member, which is wound in a spring coil shape and then deformed into a circle, and the ring coil member is attached to the outside of the band member.

5. The accessory of claim 1, wherein the outer casing includes a band member, which is elastically closely adhered to the circumference of the cylindrical part of the sound field-forming member and a plurality of ring-shaped supporting rings, which are positioned circularly in a standing state, and inner parts of each of the ring-shaped supporting are attached to the outside of the band member as one body.

6. The accessory of claim 1, wherein various colored designs and/or characters a printed on the surface of the outer casing.

7. The accessory of claim 1, wherein the outer casing is formed by filling the inside of a hollow ring-shaped tube with a medium having a function for keeping warm or cold.

8. The accessory of claim 1, wherein the outer casing includes a plurality of acupressure protrusions, which protrude from at least the part of the surface of the outer casing and stimulate pressure points on the side of the listener's head around the ears.

9. The accessory of claim 1, wherein the outer casing further includes a cotton or woolen cloth cover.

10. The accessory of claim 1, wherein the outer casing further includes a fixed ring, which is fixed onto an end of the cylindrical part of the sound field-forming member to prevent the outer casing from slipping off of the cylindrical part.

11. The accessory of claim 10, wherein said outer casing and said ring are not integrated into a single body.

12. The accessory of claim 1, wherein said cylindrical part is a tubular member, and the outer casing is an annular, resilient member fitted over an outer surface of said tubular member.

13. The accessory of claim 12, wherein said tubular member and said annular outer casing are not integrated into a single body.

14. A headphone accessory, comprising:

a sound field-forming member having a cylindrical part, which supports speaker units for reproducing sound from electrical signals or supports enclosures in which the speaker units are mounted, surrounds a listener's ears and forms a space in which sound output from the speaker units or enclosures is collected into the listener's ears; and an outer casing formed of an elastic material, which can be separated from the circumference of the cylindrical part of the sound field-forming member and is directly in contact with the side of a listener's head around the ears;

wherein the outer casing includes a band member, which is elastically closely adhered to the circumference of the cylindrical part of the sound field-forming member, and a ring coil member, which is wound in a spring coil shape and then deformed into a circle, and the ring coil member is attached to the outside of the band member.

15. An accessory for a multi-channel headphone, said accessory comprising:

at least two speaker units;

at least two enclosures adapted to be positioned in the front and back of one ear of a listener, respectively, one of the speaker units being enclosed in each of said at least two enclosures;

a sound field forming member having a tubular part, which supports said at least two enclosures, is adapted to surround said ear of the listener, and forms a space for widening a sound field output from the speaker units of aid at least two enclosures; and an outer casing formed of an elastic material, said outer casing being removably attached to a circumference of the tubular part of the sound field forming member, and said outer casing being adapted to be in direct contact with a side portion of the listener's head around said ear.

16. The accessory of claim 15, wherein the outer casing has an annular shape and includes a plurality of disc-shaped supporting sections that are positioned around the circumference of the tubular part of the sound field forming member;

each of said disc-shaped supporting sections includes an inner part and an outer part which is further from the tubular part than the inner part; and the outer parts of adjacent said disc-shaped supporting sections are spaced from each other in a circumferential direction of said tubular part.

17. The accessory of claim 16, wherein the inner parts of adjacent said disc-shaped supporting sections are connected to one another.

18. The accessory of claim 16, wherein the inner parts of adjacent said disc-shaped supporting sections are also spaced from each other in the circumferential direction of said tubular part.

19. The accessory of claim 15, wherein the outer casing includes an annular band member, which elastically surrounds the circumference of the tubular part of the sound field forming member, and a helical coil member extending circumferentially along and attached to an outer side of the band member.

20. The accessory of claim 15, further comprising a fixing ring, which is fixed onto an end of the tubular part of the sound field forming member to prevent the outer easing from slipping off the tubular part, wherein said outer casing and said ring are not integrated into a single body.

* * * * *